US009810500B2

(12) United States Patent
Murphy, II et al.

(10) Patent No.: US 9,810,500 B2
(45) Date of Patent: Nov. 7, 2017

(54) ELECTROMECHANICAL TRIGGER GUARD PROTECTIVE ENCLOSURE

(71) Applicants: William Lewis Murphy, II, Orlando, FL (US); Robert Vail Harvey, Orlando, FL (US)

(72) Inventors: William Lewis Murphy, II, Orlando, FL (US); Robert Vail Harvey, Orlando, FL (US)

(73) Assignee: Gun Guardian LLC, Orlando, FL (US)

( * ) Notice: Subject to any disclaimer, the term of this patent is extended or adjusted under 35 U.S.C. 154(b) by 0 days.

(21) Appl. No.: 13/732,583

(22) Filed: Jan. 2, 2013

(65) Prior Publication Data

US 2014/0182180 A1 Jul. 3, 2014

(51) Int. Cl.
*F41A 17/54* (2006.01)
*F41A 17/06* (2006.01)

(52) U.S. Cl.
CPC ..... *F41A 17/54* (2013.01); *F41A 17/06* (2013.01)

(58) Field of Classification Search
CPC ..... F41A 17/06; F41A 17/066; F41A 17/54
USPC ..... 42/70.07
See application file for complete search history.

(56) References Cited

U.S. PATENT DOCUMENTS 3,392,471 A 7/1968 Foote
4,422,254 A * 12/1983 McQueen ..... F41A 17/46 42/70.05
5,075,994 A * 12/1991 Nishioka ..... F41A 17/54 42/70.07
5,229,532 A 7/1993 Brooks
5,419,068 A * 5/1995 Pages et al. ..... 42/70.07
5,638,627 A 6/1997 Klein et al.
6,141,896 A 11/2000 Oberst
6,154,995 A * 12/2000 Lenoir ..... F41A 17/54 42/70.07
6,253,480 B1 * 7/2001 Florez ..... 42/70.11
6,405,861 B1 6/2002 Siler et al.
7,030,729 B2 * 4/2006 Albanesi et al. ..... 340/5.61
7,194,836 B1 * 3/2007 Urban ..... 42/60
8,713,836 B1 * 5/2014 Haq ..... F41A 17/54 42/70.06
9,097,479 B1 * 8/2015 Barido ..... F41A 17/54
9,404,699 B1 * 8/2016 Barido ..... F41A 17/54
9,459,064 B1 * 10/2016 Xu ..... F41A 17/54
2010/0154271 A1 * 6/2010 Victor et al. ..... 42/70.07
2012/0137559 A1 * 6/2012 Burns, III ..... F41A 17/54 42/70.06

(Continued)

*Primary Examiner* — Stephen Johnson
*Assistant Examiner* — Benjamin Gomberg
(74) *Attorney, Agent, or Firm* — Jason T. Daniel, Esq.; Daniel Law Offices, P.A.

(57) ABSTRACT

The electromechanical trigger guard protective enclosure is a safety device intended to prevent access to the trigger of any firearm with an accessory rail. The present invention has a keypad, which activates the drive mechanism. The drive mechanism either covers the trigger or slides open revealing the trigger for use. The protective enclosure is affixed to the accessory rail on a gun, ensuring that it is able to be used at all times, preventing any inability to properly enclose the trigger. This protective sheath allows for the weapon to remain loaded and ready to fire at all times, aiding greatly in times of self-defense.

11 Claims, 11 Drawing Sheets

(56) References Cited

U.S. PATENT DOCUMENTS

| | | | | |
|---|---|---|---|---|
| 2016/0054083 | A1* | 2/2016 | Kiyani | F41A 17/063<br>42/70.11 |
| 2017/0023324 | A1* | 1/2017 | Xu | F41A 17/54 |

* cited by examiner

ELECTROMECHANICAL TRIGGER GUARD PROTECTIVE ENCLOSURE

CROSS-REFERENCE TO RELATED APPLICATIONS

Not applicable.

STATEMENT REGARDING FEDERALLY SPONSORED RESEARCH OF DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

According to the Center for Disease Control, in the United States between 2000 and 2009, 1,320 children between the ages of 1 and 18 died due to unintentional firing of a firearm (the 9th largest killer). The reasons and scenarios leading to the discharge of the weapons vary widely from case to case, but one common factor of all accidental shootings is that they could have been avoided using safe weapon stowage and handling procedures, combined with an awareness of the present environment and surroundings. While there are a large number of methods for securing a firearm available today, most are cumbersome and require varying amounts of operator input. Some of these securement methods are not portable, limiting gun safety to the one location in which the gun is normally kept. With other currently available portable devices, the operator is required to carry a physical key, attach or remove parts, remember a particular set of procedures, or remove the ammunition in order to secure the weapon. Still other safety devices require the weapon's mechanical components to be disassembled, altered, and re-assembled. In short, many options for safely storing a firearm are available, but each of these options makes it difficult and inconvenient to ensure that a firearm is not capable of harm.

Perhaps the most secure method of protecting a firearm is to store it in a locker or trunk. However, due to their sheer size and weight, these units are primarily designed to be installed and operated within the confines of a single environment, i.e., a gun owner's bedroom or vehicle. Unless the weapon is always in the locker, there is a large likelihood that the gun may be left out in the open without proper safety precautions being taken.

As an alternative to storage lockers, many people install portable safety devices on their weapons. To use these devices, an owner will have his weapon modified from the original production configuration to incorporate safety mechanisms that prevent the weapon from inadvertently being discharged. This process may result in the loss of warranty and liability claims to the weapon's manufacturer. This modification often results in a safety system that is not visible, thus not readily verifiable at any given point in time. Additionally, a system that is incorporated into the mechanical workings of the gun may not be obvious to people other than the owner, thus causing difficulty when others attempt to engage the safety features of the weapon.

Portable aftermarket safety units available today are inserted into various parts of the handgun and then locked, preventing the pieces from being removed, thus preventing the guns from firing. While this type of protection presents a clean and cost effective solution, it requires the user to keep track of the insert and a key, which are not stowed on the firearm itself when the weapon is in use. A variation on the aftermarket insert is the trigger guard insert or cover that prevents access to the weapon's trigger. This safety component removes the ability to fire the weapon, regardless of whether the weapon is loaded or not. As with the other available aftermarket solutions, the trigger guard lock requires storage of the lock, and often a key, when the gun is in use. While the trigger guard lock is a good method for preventing access to the trigger, it can get lost or misplaced, still causing opportunity for the weapon to be discharged unintentionally.

It is the aim of the present invention to address the shortfalls of the prior art described above.

BRIEF SUMMARY OF THE INVENTION

While many firearm safety devices provide the desirable end result of an inoperable weapon, the process required to arrive at a favorable result is unsatisfactory. It is the intent of the present invention to provide a method for safely securing a handheld firearm in an easy, efficient, and portable method. The present invention consists of an electromechanical system that drives a sheath, which fully encloses the trigger guard of a handgun. The present invention is designed to mount to the firearm using the manufacturer's accessory rail. A programmable electronic keypad is used to activate a drive system, which opens or closes the sheath that fully envelops the trigger guard area.

Unlike prior art examples such as U.S. Pat. No. 6,405,861, Handgun Storage Case and Method for Safe and Quick Access, the present invention's functionality is not restricted to a locker or trunk mounted to a particular wall of a home or stored in an obscure corner of a vehicle. Because the Electromechanical Trigger Guard Protective Enclosure (ET-GPE) is securely mounted to the accessory rail of the handgun, the safety of the weapon can be ensured at all times in any location.

U.S. Pat. No. 5,229,532, Grip Lock Assembly, discloses an invention that requires the removal of the manufacturer's original equipment handle grip and replacement of it with an aftermarket handle grip. While the Grip Lock Assembly addresses the need for safety, the installation of the aftermarket handle grip will void the manufacturer's warranty. Additionally, improper installation may occur, thereby negating the safety intents of the invention. The present invention easily installs on the manufacturer's accessory rail. No original parts of the firearm are removed or altered so the manufacturer's warranty is not voided.

Unlike U.S. Pat. No. 5,229,532, the present invention will provide both visual and audible confirmation that the device is securely locking the trigger guard area. A small light emitting diode will provide a visual indicator as to the present status of the safety mechanism; the operator can opt to have the LED change color or blink in a recognizable pattern to confirm. An audible tone will be emitted when the device has completed the extension into the deployed position. These two features ensure that the operator can both see and hear confirmation that the weapon is properly secured.

Lockable Firearm Safety, U.S. Pat. No. 6,141,896, describes a method for using a keyed bolt lock to prevent accidental firing of a firearm. While the invention achieves the result of securely locking the firearm, its function requires the use of a physical key. The resulting problems are that using a key is not always efficient in times of high-stress and/or anxiety, and keys are often misplaced or lost, thereby negating the safety feature if the device is off the firearm or rendering the weapon inoperable if the device is on the firearm. By using an integrated keypad, the present invention allows the firearm to be accessed without searching or fumbling for the physical key. The present invention also maintains an enclosed trigger guard area during the unlocking process, which ensures no accidental firings.

Like U.S. Pat. No. 6,141,896 detailed above, U.S. Pat. No. 3,392,471, Adjustable Trigger Locks for Firearms, uses a physical key for the securement of a firearm. Unlike the previously referenced patents, the Adjustable Trigger Locks for Firearms secures a weapon by inserting a case or covering along the outer face of the trigger guard. With this invention, the operator must locate a physical key to unlock and remove the safety device and then store the device and key somewhere for later re-installation, resulting in the potential for the case or key being misplaced at any point. Having to remove the safety device to use the weapon is very much contrary to the design of the present invention. The present invention remains on the firearm at all times and does not use a separate key for its operation.

The installation of the locking mechanism on U.S. Pat. No. 3,392,471 requires insertion of a device through the trigger guard. This process of inserting the device could cause accidental discharging of the weapon if the user inadvertently makes contact with the trigger of a loaded weapon. The present invention is designed to fully enclose the trigger guard, thereby avoiding any contact with the trigger or trigger guard area when engaging or disengaging the safety device.

The Combination Trigger Lock, U.S. Pat. No. 5,638,627, improves upon the trigger guard lock described in U.S. Pat. No. 3,392,471 by negating the need for a physical key. This patent discloses the use of a combination lock on the trigger guard cover to allow access to the trigger of the firearm. While this simplifies the amount of objects an operator must keep track of, it still requires constant awareness of the whereabouts of the two mating "halves" that encase the trigger guard. Additionally, the process of securing the trigger lock may still allow for the inadvertent firing of the weapon. In a similar fashion to U.S. Pat. No. 5,638,627, the present invention eliminates the need for a physical key. However, the present invention's installation on the accessory rail eliminates the problem of misplaced or lost parts. The present invention improves safety by not requiring the user to insert any components through the internal cavity of the trigger guard in order to fully engage and restrict access to the trigger of a firearm, greatly reducing the probability of accidentally discharging the weapon.

Figure 11:
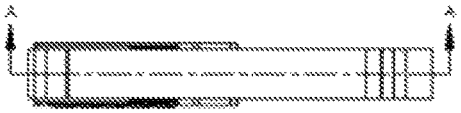
Figure 11:
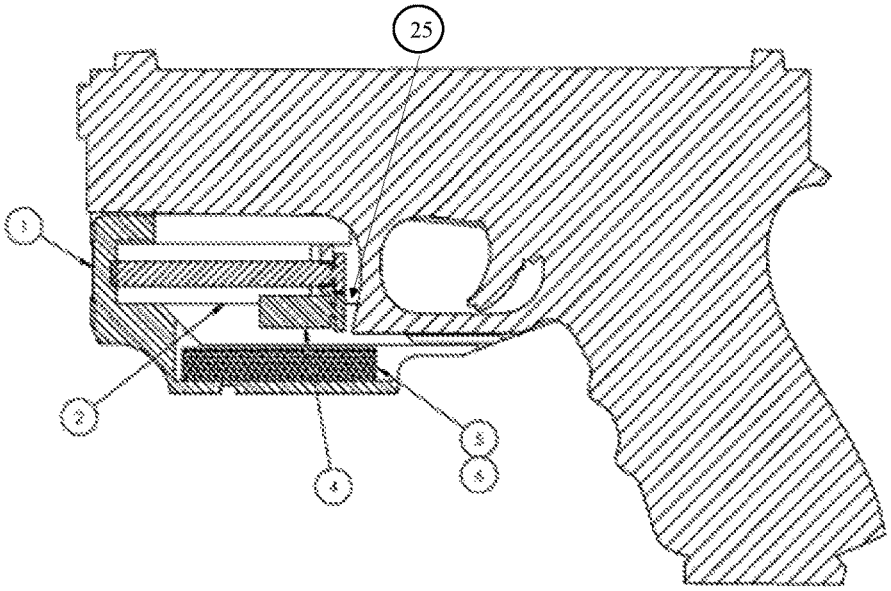

1. Stationary Housing
2. Non-Stationary Sheath
3. Keypad
4. Electro-mechanical Drive Assembly (Motor, Gears, Lead Screw, Housing)
5. Control Electronics/Internal circuitry
6. Power Source FIG. 11. This figure provides a side view of the inner assembly of the present invention (outer case has been removed) in the deployed (closed) position.

DETAILED DESCRIPTION OF THE INVENTION

Figure 1:
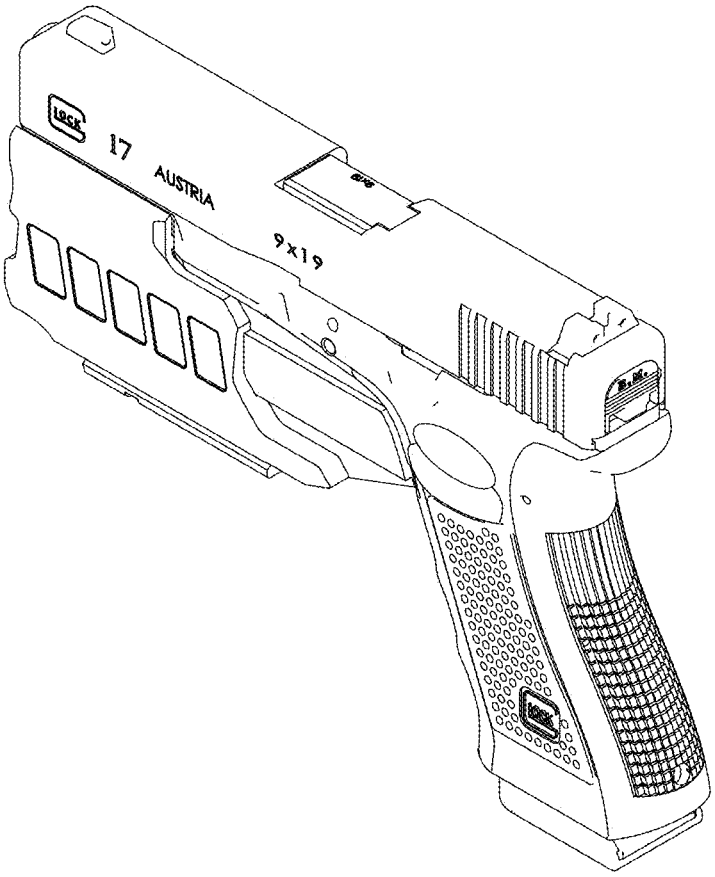
FIG. 1. This figure provides a perspective view of the present invention installed on a handgun in the deployed (closed) position.
Figure 2:
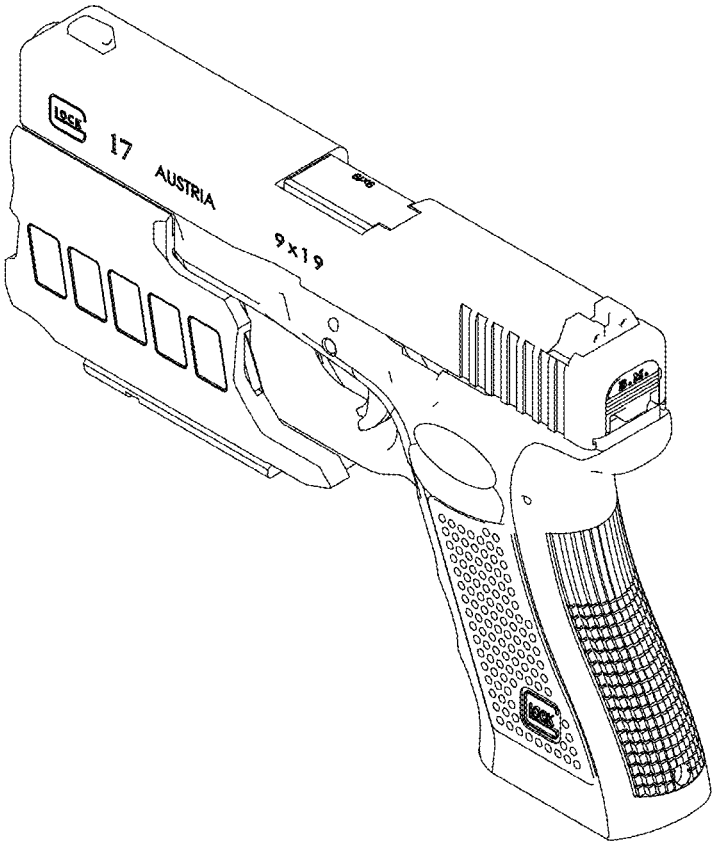
FIG. 2. This figure provides a perspective view of the present invention installed on a handgun in the retracted (open) position.
Figure 3:
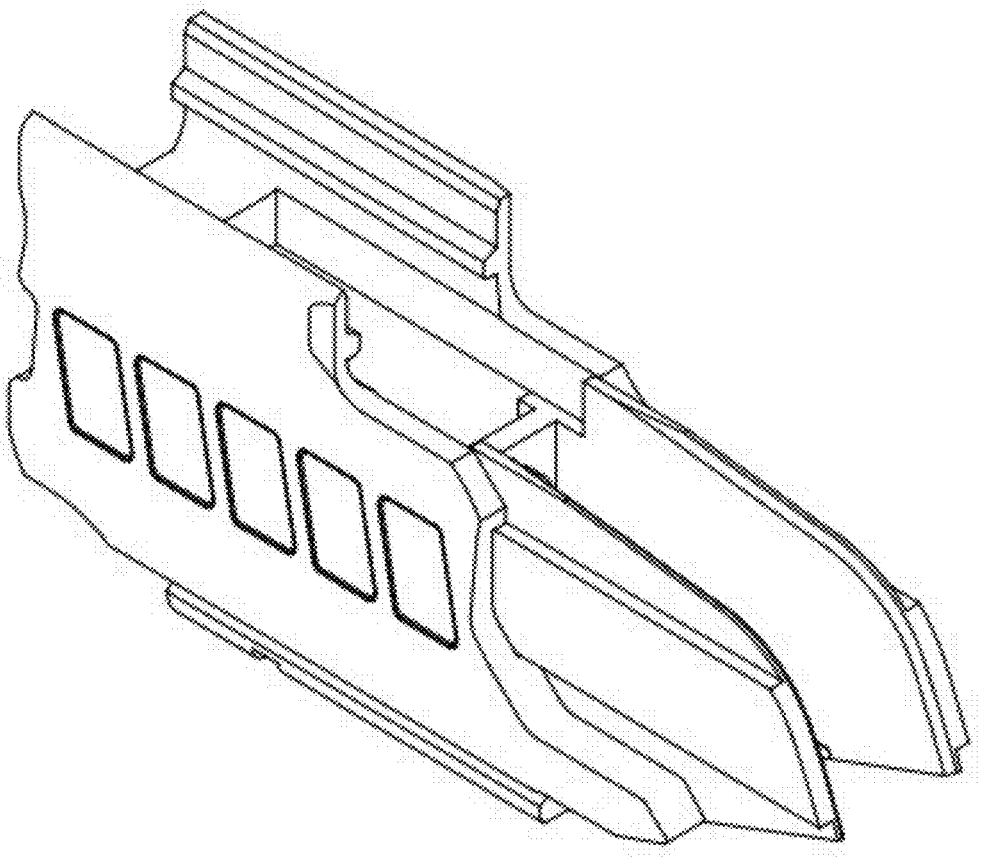
FIG. 3. This figure provides a perspective view of the present invention in the deployed (closed) position.

The present invention, the Electromechanical Trigger Guard Protective Enclosure (ETGPE), presents a novel and unique approach to ensuring a firearm is securely protected from unwanted firing while still allowing the weapon to be unlocked and prepared for use expeditiously in a time of need. FIG. 1 shows the present invention installed on an exemplary handgun. The present invention is comprised of seven main components: a stationary sheath (1), a non-stationary sheath (2), a keypad (3), a motor and mechanical drive (4), internal circuitry (5), a power source (6) and a method for locking the accessory to the weapon. Each of these items will be discussed in detail, allowing a person having ordinary skill in the art to understand the assembly and installation of the ETGPE.

Figure 8:
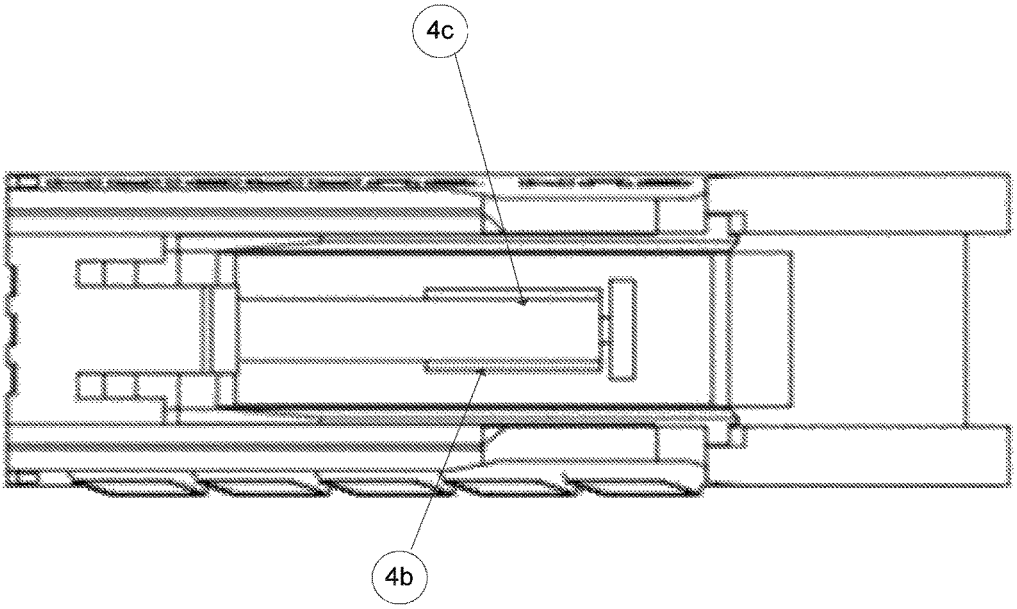
FIG. 8. This figure provides a top view of the present invention in the retracted (open) position.
Figure 9:
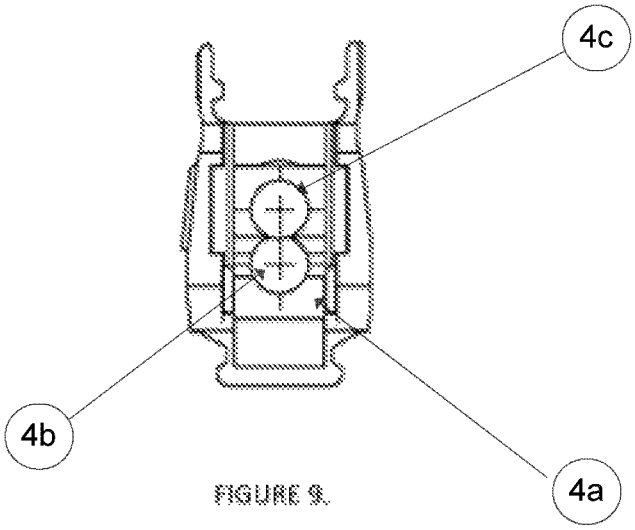
FIG. 9. This figure provides a rear view of the present invention in the retracted (open) position.
Figure 10:
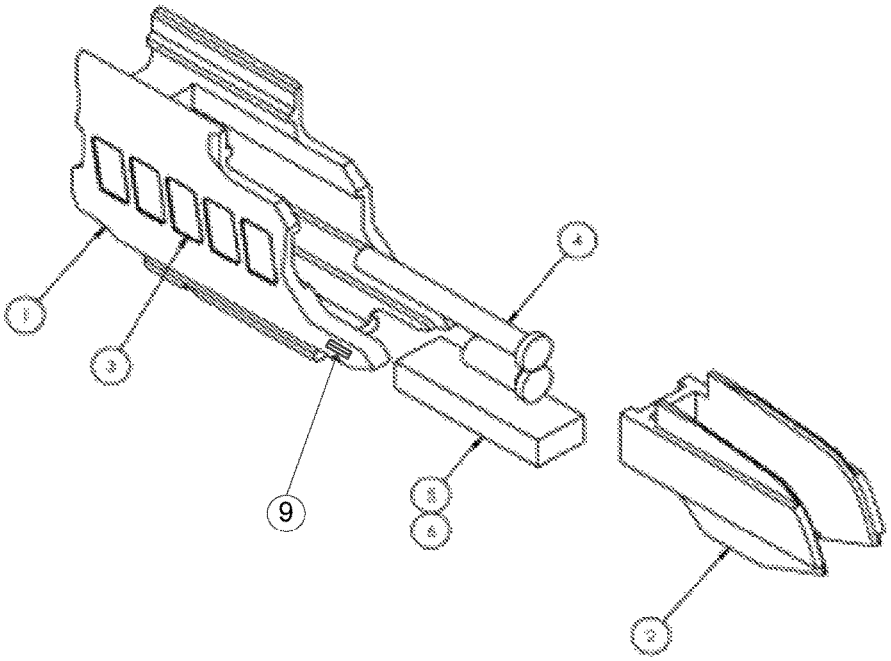
FIG. 10. This figure provides an exploded assembly view of the present invention. The items in the exploded view are as follows.

The ETGPE core functionality is based on a design that consists of a central enclosure contained within the stationary sheath (1) that is secured to the underside of the barrel of the weapon by means of the weapon's accessory rail. As shown in FIG. 8, the central enclosure houses the motor and mechanical drive system (4), the internal circuitry (5), and the power source (6). When the central enclosure and the stationary sheath (1) are affixed to the accessory rail, access to the items housed internally is not possible. If the central enclosure is not affixed, it is possible to access the internal components for repair, modification, or replacement.

The central enclosure is designed to slide onto the weapon's accessory rail, and securely lock to the accessory rail with setscrews. The location of these screws is such that when the non-stationary sheath (2) is deployed, the screws are inaccessible. As an additional optional safety measure, the screws could have proprietary heads that require special tools to tighten or loosen said screws. When in the retracted position, openings in the non-stationary sheath (2) align with the locations of the screw heads offering access to the setscrews for any necessary adjustment or removal. An alternative embodiment of the present invention uses a pin 25 inserted through the trigger guard cavity to locate and lock the stationary sheath (1) to the weapon. As in the preferred embodiment, this pin is only accessible when the non-stationary sheath (2) is in the retracted position, eliminating the possibility of tampering or removal while in the deployed configuration. In all configurations, once installed on a weapon, the ETGPE is intended to remain as a part of the weapon indefinitely, ensuring a quick and efficient method for securing a loaded weapon.

Within the stationary sheath's enclosure is the motor and mechanical drive system (4). In the preferred embodiment, the motor 4*a* drives a lead screw 4*b*, which turns a threaded shaft 4*c*, located along the longitudinal axis of the gun, but beneath the barrel of the weapon. The threaded shaft is mechanically connected to the non-stationary sheath (2), providing a means for the mechanical translation of the non-stationary sheath (2) when the threaded shaft rotates. When the motor is driven in the positive direction, the shaft rotates in the positive direction, advancing the non-stationary sheath (2) towards the handle of the weapon. If the motor is driven in the opposite direction (negative), the motion of the non-stationary sheath is reversed, resulting in the non-stationary sheath (2) approaching the retracted position. The use of a lead screw drive gear configuration ensures that the non-stationary sheath (2) cannot be moved along the threaded shaft unless the motor is in an active or driven state. In all passive modes (meaning the motor is not actively being driven), the ETGPE lead screw drive does not allow for the non-stationary sheath (2) to be retracted, ensuring the safety of the weapon in the event of motor or circuitry failure.

The motor for the mechanical drive system receives power from an on-board power source (6). The preferred embodiment uses a traditional battery configuration that is stored internally in the central enclosure. While the low power consumption and minimal draw on the battery will ensure the longevity and reliability of the system, it is inevitable that the battery will need recharging at some point. The ETGPE has both audible and visual alerts to notify the operator that the internal power supply is entering reserve capacity. Upon acknowledgement of these warnings, the system is designed to accept an external power source to recharge the internal battery. The stationary sheath (1) has an external port 9 that can be used to apply an external power supply to the ETGPE, allowing the battery to be recharged without the need for removal from the weapon. In the event that the audible and visual alerts are not observed, the ETGPE will shut down; thereby rendering the weapon unable to be unlocked or fired until an external power source provides power or the internal battery is recharged.

Pivotal to the operation of the system is the circuitry (5) housed within the central enclosure. The circuitry (5) is connected to the various other components through independent but interconnected wiring runs. The circuitry (5) is responsible for interpreting keypad entries and engaging the drive motor accordingly. The circuitry (5) additionally provides non-volatile storage of unique operator information, such as the access pin code.

Figure 6:
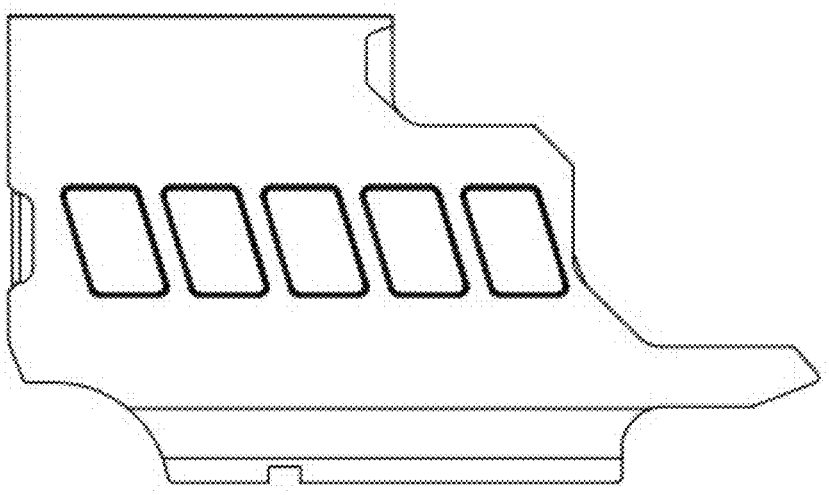
FIG. 6. This figure provides a side view of the present invention in the retracted (open) position.
Figure 7:
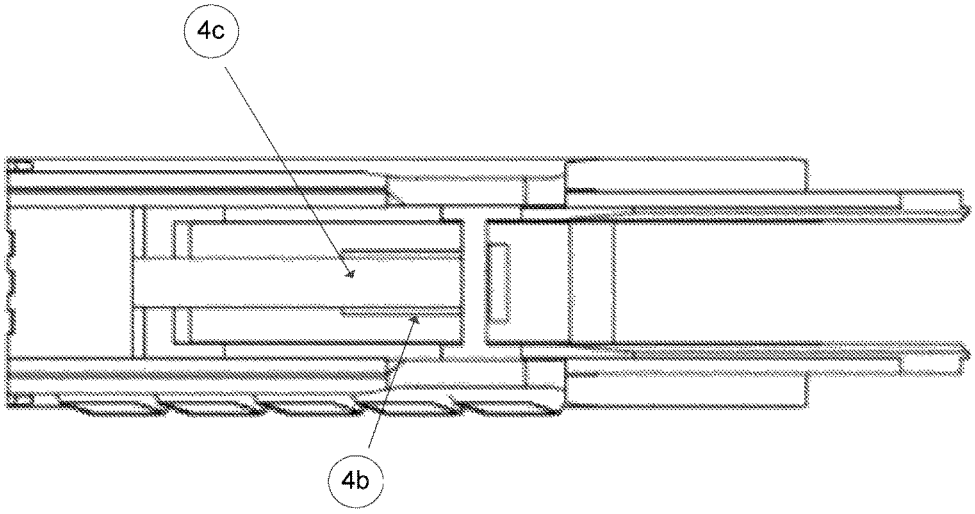
FIG. 7. This figure provides a top view of the present invention in the deployed (closed) position.

Riding on rail-like protrusions along the inwardly facing vertical faces of the stationary sheath (1) is the non-stationary sheath (2). Unlike the stationary sheath (1), the non-stationary sheath (2) is not fixed in position. It is the intent of the non-stationary sheath (2) to slide in such a manner that it entirely envelops the trigger guard and trigger guard cavity while in the deployed position, preventing access to the trigger. As shown in FIG. 6, the non-stationary sheath (2) is "U" shaped, allowing it to slide along the stationary sheath (1) without obstruction, fully sealing off the trigger guard area when the rearward-most portion of the non-stationary sheath (2) makes contact with the handle of the weapon.

Figure 4:
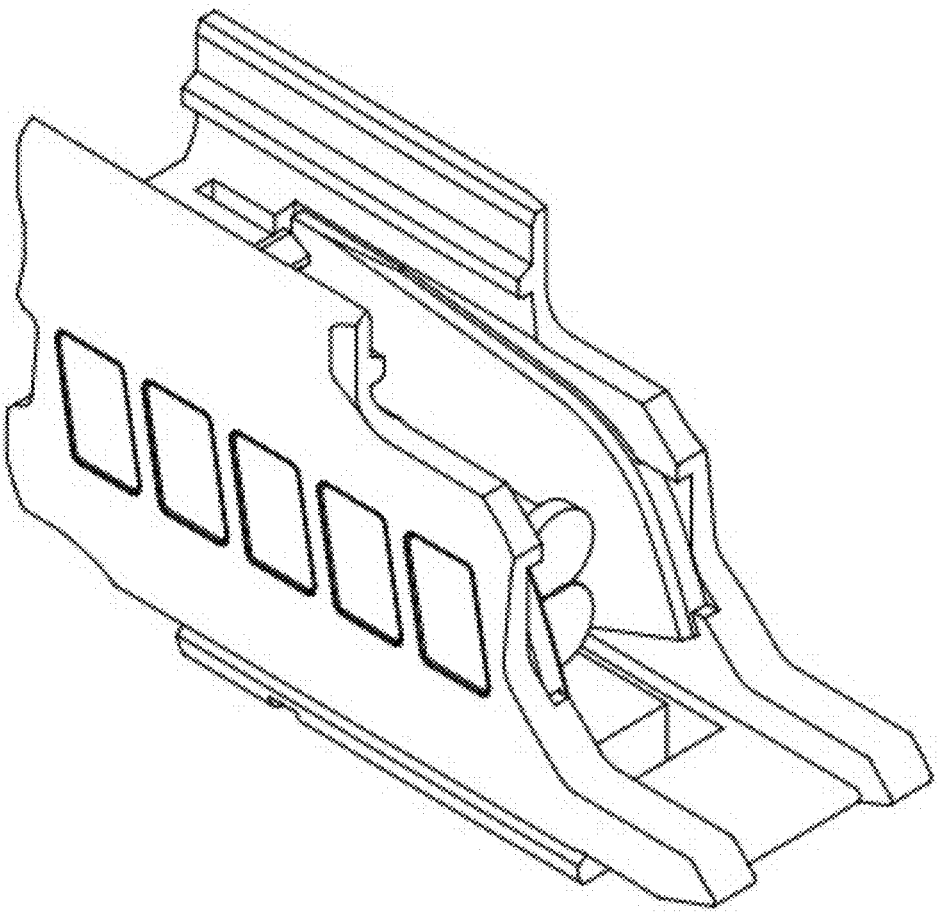
FIG. 4. This figure provides a perspective view of the present invention in the retracted (open) position.
Figure 5:
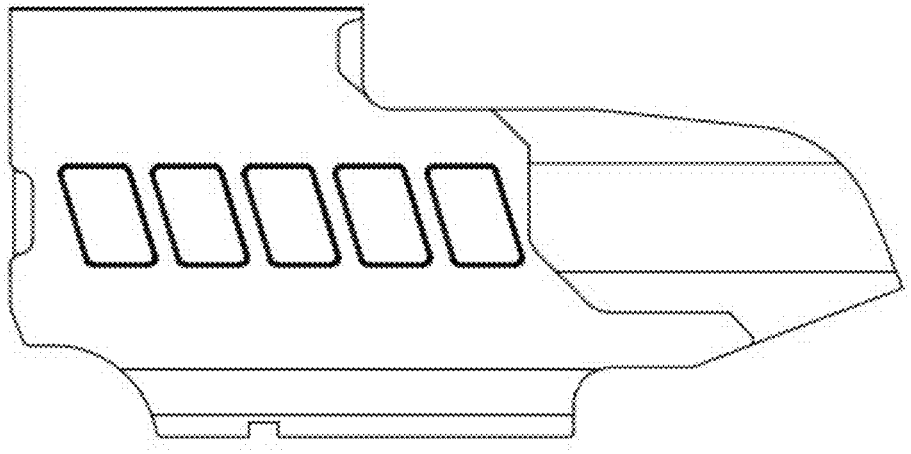
FIG. 5. This figure provides a side view of the present invention in the deployed (closed) position.

As shown in FIG. 4, the access keypad (3) is affixed along one of the outwardly facing vertical faces of the stationary sheath (1). The ETGPE is designed to be in a locked and unmovable state while in a passive mode. This feature prevents any tampering with or destroying of the keypad that allows access to the trigger area of the weapon. The keypad is programmable to allow for the operator to set a unique sequence of keystrokes that will engage the system. Only when the keypad accepts the proper sequence of keystrokes does it send a command to the motor (4), allowing the mechanical drive to open the non-stationary sheath (2). In all other instances, the non-stationary sheath (2) remains in a mechanically locked position. In the preferred embodiment, the keypad will have tactile input sources or buttons. These buttons may be adorned with a variety of alphanumeric characters, colors, geometric shapes or any other desired visible differentiator to allow for the operator to differentiate between each of the buttons. Optionally, the buttons may be illuminated and provide audible confirmation of the depression of each button. The preferred embodiment uses a digital keypad as an input source, but alternative embodiments may include items such as mechanical combination locks or biometric means of identification.

The above description of the individual components comprises the whole of the Electromechanical Trigger Guard Protective Enclosure. In practice, the ETGPE is installed on a weapon and a unique personal access code is programmed into the unit giving only the operator access to the weapon and the ETGPE. The key sequence is entered, and the unit is driven to a deployed position, covering and protecting the trigger guard cavity with no potential for accidental discharging of the weapon, even if the weapon is left with rounds of ammunition in a loaded position (FIG. 1). Because there is no contact with the inner portion of the trigger guard, no amount of vibration, shock, or impact will cause any portion of the ETGPE to result in an accidental firing of the weapon. While not recommended, the ETGPE makes it possible to leave a fully loaded weapon within easy access of untrained persons without fear of firing of the weapon. The amount of time necessary to unlock the ETGPE and safely stow the non-stationary sheath (2) in the retracted position is quick enough to encourage even the most cautious weapon owner to carry his or her weapon at all times with the ETGPE in a deployed state. A quick entry of an access pin results in near immediate access to the trigger of the weapon. Once the weapon is ready to be secured, a keypad stroke will result in the trigger guard cavity being fully enclosed, leaving the operator with full confidence that the weapon will not be discharged accidentally.

Accessories such as lasers and flashlights can be integrated into the front face of the ETGPE central enclosure and powered from the internal power source.

Alternatively, an accessory rail can be integrated into the underside of the stationary sheath, allowing for installation of aftermarket firearm accessories such as lasers and flashlights.

As many changes could be made in the above construction and many apparently widely different embodiments of this invention could be made without departing from the scope thereof, it is intended that all matter contained in the above description or shown in the accompanying drawings shall be interpreted as illustrative and not in a limited sense.

It is also to be understood that the language used in the following claims is intended to cover all of the generic and specific features of the invention herein described and all statements of the scope of the invention, which, as a matter of language, might be said to fall there between.

What is claimed:

1. A system for restricting access to a firearm trigger of a weapon having an accessory rail, said system comprising:

a stationary sheath having a central enclosure that is defined by a forward facing end, a backward facing end, a top end, a bottom end, and an outside surface, said stationary sheath further including a pair of protrusions that are disposed along the top end thereof, said protrusions being configured to removably engage the accessory rail of the weapon, so as to position the backward facing end of the stationary sheath at a location adjacent to the firearm trigger;

a unitary and generally U-shaped non-stationary sheath that is in communication with the backward facing end of the stationary sheath;

a rechargeable and portable power source that is positioned within the central enclosure of the stationary sheath;

a user input component that is positioned along the outside surface of the stationary sheath; and an electromechanical drive system that is positioned within the central enclosure of the stationary sheath, said drive system being in communication with each of the user input component, the power source and the non-stationary sheath, and is configured to selectively transition the non-stationary sheath between at least one of a deployed position and a retracted position upon receiving an instruction from the user input component, the electromechanical drive system comprising:

a motor;

a lead screw that is in communication with the motor; and an elongated threaded shaft this is positioned centrally along a longitudinal axis of the non-stationary sheath, said threaded shaft being connected to each of the lead screw and the unitary and generally U-shaped non-stationary sheath, wherein the threaded shaft is configured to receive a rotational force from the lead screw and to impart a linear force onto a center portion of the generally U-shaped non-stationary sheath; and wherein in the retracted position, the non-stationary sheath is positioned within the central enclosure of the stationary sheath, and in the deployed position, the non-stationary sheath extends outward from the backward facing end of the stationary sheath and is configured to fully enshroud the firearm trigger of the weapon.

2. The system of claim 1, further comprising:

an accessory rail that is mounted along the bottom end of the stationary sheath.

3. The system of claim 1, further comprising:

an external port on the outside surface of the stationary sheath for recharging the power source.

4. The system of claim 1, further comprising:

a pin that is in communication with the stationary sheath, said pin functioning to lock the stationary sheath to a trigger guard of the weapon.

5. The system of claim 1, further comprising:

a plurality of setscrews that are positioned along the stationary sheath, said setscrews being configured to engage the accessory rail of the weapon and to lock the stationary sheath thereon.

6. The system of claim 5, further comprising:

a plurality of openings that are disposed along the non-stationary sheath, said openings being positioned so as to align with the plurality of setscrews when the system is in the retracted position.

7. The system of claim 6, wherein in the deployed position, the plurality of openings are not aligned with the plurality of setscrews.

8. The system of claim 1, wherein the user input component comprises:

an access keypad that is positioned along the outside surface of the stationary sheath.

9. The system of claim 8, wherein the access keypad is illuminated.

10. The system of claim 8, wherein the access keypad includes functionality for biometric identification.

11. The system of claim 1, further comprising:

at least one of an audible and visual alert that is configured to automatically activate upon the occurrence of a reserve power situation.

* * * * *